US007258559B2

(12) United States Patent
Mattern et al.

(10) Patent No.: US 7,258,559 B2
(45) Date of Patent: Aug. 21, 2007

(54) PLUG-AND-SOCKET CONNECTION DEVICE

(75) Inventors: Kirstin Mattern, Usingen (DE); Kurt Rautenberg, Neu-Anspach (DE)

(73) Assignee: Erich Jaeger GmbH + Co. KG, Friedberg (DE)

( * ) Notice: Subject to any disclaimer, the term of this patent is extended or adjusted under 35 U.S.C. 154(b) by 0 days.

(21) Appl. No.: 10/544,537

(22) PCT Filed: Dec. 21, 2004

(86) PCT No.: PCT/EP2004/014526

§ 371 (c)(1),
(2), (4) Date: Jun. 7, 2006

(87) PCT Pub. No.: WO2005/065972

PCT Pub. Date: Jul. 21, 2005

(65) Prior Publication Data

US 2006/0240695 A1 Oct. 26, 2006

(30) Foreign Application Priority Data

Jan. 12, 2004 (DE) ..... 20 2004 000 387 U

(51) Int. Cl.
*H01R 13/64* (2006.01)

(52) U.S. Cl. ..... 439/248; 439/35; 439/310; 439/140

(58) Field of Classification Search ..... 439/248, 439/247, 34, 35, 140, 310
See application file for complete search history.

(56) References Cited

U.S. PATENT DOCUMENTS 5,458,357 A 10/1995 Wohlhüter
6,863,538 B2 * 3/2005 Mattern et al. ..... 439/35
6,935,881 B2 * 8/2005 Kainz et al. ..... 439/310
2002/0038749 A1 * 4/2002 Reik et al. ..... 192/70.25

FOREIGN PATENT DOCUMENTS

FR 2 669 152 5/1992
WO 03/035415 5/2003

* cited by examiner

*Primary Examiner*—Briggitte R. Hammond
(74) *Attorney, Agent, or Firm*—Wenderoth, Lind & Ponack, L.L.P.

(57) ABSTRACT

The invention relates to a plug-and-socket connection device for the automatic, e.g. multipolar electrical connection of a vehicle trailer, particularly of a semitrailer, to a towing vehicle, particularly to a prime mover. The plug-and-socket connection device comprises a socket and a plug, which can be mounted on the vehicle trailer (e.g. the plug) or on the towing vehicle (e.g. the socket, they can be aligned with one another when coupling the vehicle trailer to the towing vehicle, and can be displaced while being guided by a drive provided in the form of an, e.g. piston/cylinder assembly relative to one another between an (advanced) connecting position and a (retracted) inoperative position. Preferably, a cover of the socket can be opened by displacing, with the aid of the drive, the contact insert, which is accommodated in the socket and which supports the contact sleeves, in the direction of the connecting position, and can be closed once again when retracting the contact insert into the inoperative position. The invention is characterized in that the plug is mounted so that it laterally yields in an elastic manner against the action of at least one retaining spring that is fixed, on one side, to the plug and, on the other side, to a fastening flange that can be fastened to a vehicle (towing vehicle or vehicle trailer).

20 Claims, 6 Drawing Sheets

A-A

PLUG-AND-SOCKET CONNECTION DEVICE

BACKGROUND OF THE INVENTION

The invention relates to a plug-and-socket connection device for the automatic electrical connection of a vehicle trailer, in particular of a semitrailer, to a towing vehicle, in particular to a prime mover, with a socket and a plug that can be mounted on the trailer and the towing vehicle, whereby as the trailer is being hitched to the towing vehicle the plug and socket can be mutually aligned and by means of a drive, e.g. in the form of a piston/cylinder assembly, can be displaced relative to each other between an advanced connection position and a retracted inoperative position. With the aid of the drive, e.g. a cover of the socket preferably opens automatically by displacement of the contact insert which is accommodated in the socket and carries the contact sleeves towards the connection point and closes again when the contact insert moves back into its inoperative position.

A plug-and-socket connection device of this type has already been proposed and the coupling position is supposed to be ensured by sensors. However, because of the usual large tolerances in vehicle building and the risk of the sensors becoming dirty during driving, the exact alignment of the plug with the socket is not that simple. Automatic operation of the coupling process is therefore called into question.

SUMMARY OF THE INVENTION

The object of the present invention is to propose a plug-and-socket connection device of the type mentioned, which without manual intervention provides considerable and automatic ease of connection between the two connector elements.

With a plug-and-socket connection device of the type mentioned this object is essentially achieved by the fact that the plug is mounted in a way allowing elastic lateral deflection against the action of at least one retaining spring attached both to the plug and to a mounting flange attached to a vehicle (prime mover or trailer).

The solution according to the invention ensures that the automatic union of plug and socket can be effected easily and securely even in the case of larger tolerances or inaccurate sensors.

In this context it should be mentioned that the terms "socket" and "plug" with regard to their respective functions as the two connector elements of a plug-and-socket connection device used in this description are mutually exchangeable i.e. those design features described and presented here for a socket or a plug can also apply in reverse. In order to keep the description simple the terms "socket" and "plug" are used in the following to distinguish between the two connector elements of a plug-and-socket connection.

In a special embodiment of the invention, the retaining spring for the plug is designed as a spiral spring surrounding the plug housing and preferably essentially coaxial with the housing. Furthermore, this spring preferably tapers in a forward direction. However, there may also be more than one retaining spring, e.g. three or four individual single springs acting symmetrically on the plug to re-center it after its lateral deflection. This ensures that after disconnection of the plug-and-socket connection the plug returns reliably to the correct starting position if it has been deflected laterally.

In a further development of the inventive concept the envisaged object is still better attained if the plug housing features a lead-in funnel for the socket, because with its aid the socket can be securely inserted into the plug even in the case of misalignment within the set tolerances.

The lateral deflection of the plug can be ensured in a simple manner if the plug housing is braced at the rear on a retaining plate by means of a ball bearing or simple spherical surfaces.

For further tolerance compensation in an axial direction, it is advantageous if the retaining plate, carried on the mounting flange for the plug housing, is braced by a return spring. This also ensures lateral swivelling of the plug housing against the action of the return spring as well as of the retaining spring(s) for the plug.

In order to largely prevent the contact pins of the plug from becoming dirty and yet ensure automatic establishment of the plug-in connection, the invention further proposes that the plug housing that accommodates the contact mount carrying the contact pins is sealed off in the rest position by a cover plate e.g. behind the lead-in funnel. This cover plate preferably features openings for the contact pins and can move, in particular slide, against the action of a return spring from the forward rest position and with release of the contact pins to a rearward connection position. In this way automatic opening and closing of the plug housing by insertion and retraction respectively of the socket is achieved. In the rest position, i.e. when not in use, the contact pins are protected. The arrangement is preferably so that in the rest position of the cover plate, the contact pins just close the openings. This also means that the contact pins can serve as guides for the to and fro motion of the cover plate.

For the protection of the inner space it may further be provided that the outer edge of the cover plate in rest position is pressed by its return spring against an inner shoulder of the plug housing if necessary by the interposition of a sealing ring.

A sealing ring may be mounted in the plug housing at the front end of a spacer sleeve.

To simplify assembly, the return spring for the cover may be a spiral spring surrounding the contact mount and is preferably fixed at its rear in a ring groove.

In accordance with a further inventive feature, the plug housing is equipped with a stopper accommodating a valve core which in assembled condition points downward. The valve core carries a baffle through which condensation water can drain while the infiltration of water (road spray, steam jets) from outside is prevented.

To secure the plug-in connection of plug and socket in the operative position and to reliably hold the socket in its inoperative position, the drive can be locked in either the operative or the inoperative position.

To facilitate assembly and disassembly, the contact insert can be detachably connected e.g. with a screw connection, to the piston of the drive, which may be a pneumatic piston-cylinder assembly.

In a further development of the invention, to ensure that the contact sleeves remain properly aligned with the contact pins of the plug, the contact insert of the socket may be mounted on a base plate, also serving as mounting plate, to resist torsion.

This base plate may be equipped with a housing section encompassing the contact insert and featuring ball elements distributed over its circumference. This allows the contact insert to be secured in two defined positions (starting position=unlocked, operative position=locked).

Optionally the plug-and-socket connection device of the invention may feature an emergency release which, in the case of power failure, allows mechanical separation of socket and plug. The plug- and-socket connection device may also feature protection of the socket against torsion, code protection of the socket, sensors for position detection, protection of the plug housing against being lifted from the retaining plate, and/or a locking device for the contact insert in inoperative and operative position to further increase the functional reliability.

BRIEF DESCRIPTION OF THE DRAWINGS

Further aims, features, advantages and application possibilities of the present invention become clear from the description of embodiments below with reference to the drawings. All features described and/or illustrated, alone or in any combination, represent the subject of this invention, also independent of their summary in individual claims or their cross-reference.

DETAILED DESCRIPTION OF THE INVENTION

The plug-and-socket connection device shown in the figures which can be used in a truck/semitrailer combination and then must be mounted near the trailer coupling, consists of a plug S, for example mounted on the trailer, and a socket D, for example mounted on the towing vehicle. When the trailer is hitched to the towing vehicle, plug S and socket D must align automatically which is made possible mainly with the aid of sensors determining the position of the trailer relative to the towing vehicle. By means of a drive 10 in the form of a piston-cylinder assembly the two connector elements D, S are joined. The drive 10 is designed so that it can move the socket D from a retracted rest position while the connection is not in use to an advanced connection position when the connection must be established whereby the socket D cooperates with the plug S. When the plug-in connection is separated, the direction of movement of the socket D is reversed.

Figure 1:
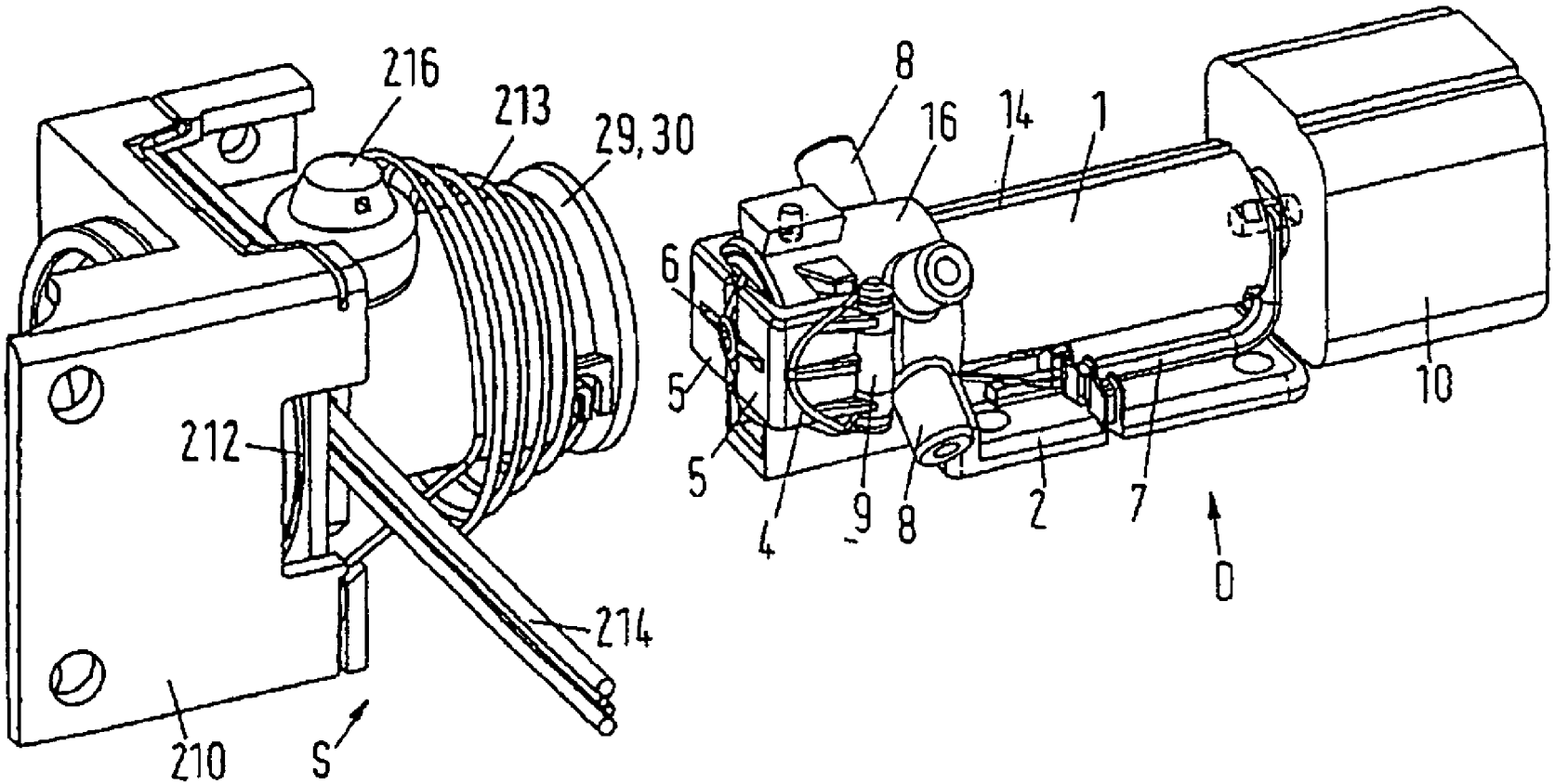
FIG. 1 is a first oblique view of a plug-and-socket connection device, according to the present invention just before insertion of a socket into a plug.
Figure 3:
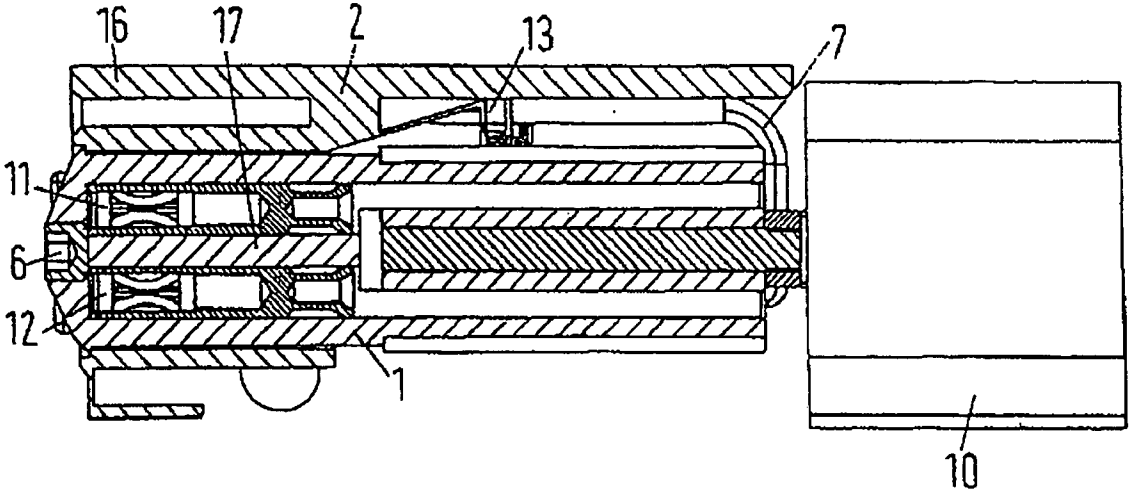
FIG. 3 is a longitudinal section of the socket of the present invention.
Figure 3A:
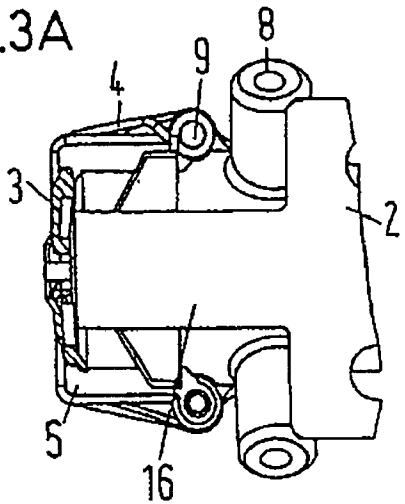
FIG. 3A is a top view of a front section of the socket of FIG. 3.

The socket D as shown most clearly in FIG. 1 and FIG. 3A has a cover 5 consisting of two flaps. The flaps of the cover 5 can pivot on swivel pins 9 of a circular housing section 16 of a base plate 2 against the action of return springs 4 in the form of leg springs. As the contact insert 1 carried on the base plate 2 moves into the connection position, the two flaps of the cover 5 swivel outwards and return to their closing position by means of the return springs 4 when the contact insert 1 moves back to its rest position. To ensure tight sealing, the forward end of the contact insert 1 and of the housing section 16 is equipped with a sealing disc 3 against which the flaps of the cover 5 come to rest in closing position. Torsion-free operation of the contact insert 1 is ensured at the housing section 16 by means of an outer longitudinal groove 14 in the casing of the contact insert 1 and a corresponding inner longitudinal rib 15 of the housing section 16. The contact insert is disconnectably attached to the front end of the piston 17 of the piston-cylinder assembly 10 by means of a hexagon socket screw. A cable 7 for the supply of the contact insert 1 is integrally cast into the base plate 2 and stress-relieved by means of a clamp 13. The housing section 16 of the base plate 2 carries radially projecting ball elements 8 divided over its outside circumference which serve to hold the contact insert 1 in two defined positions (starting position=unlocked, operative position=locked).

The drive 10 is locked both in the advanced connection position and the retracted rest position of the socket D to secure the socket D against positional change in both positions.

Figure 2:
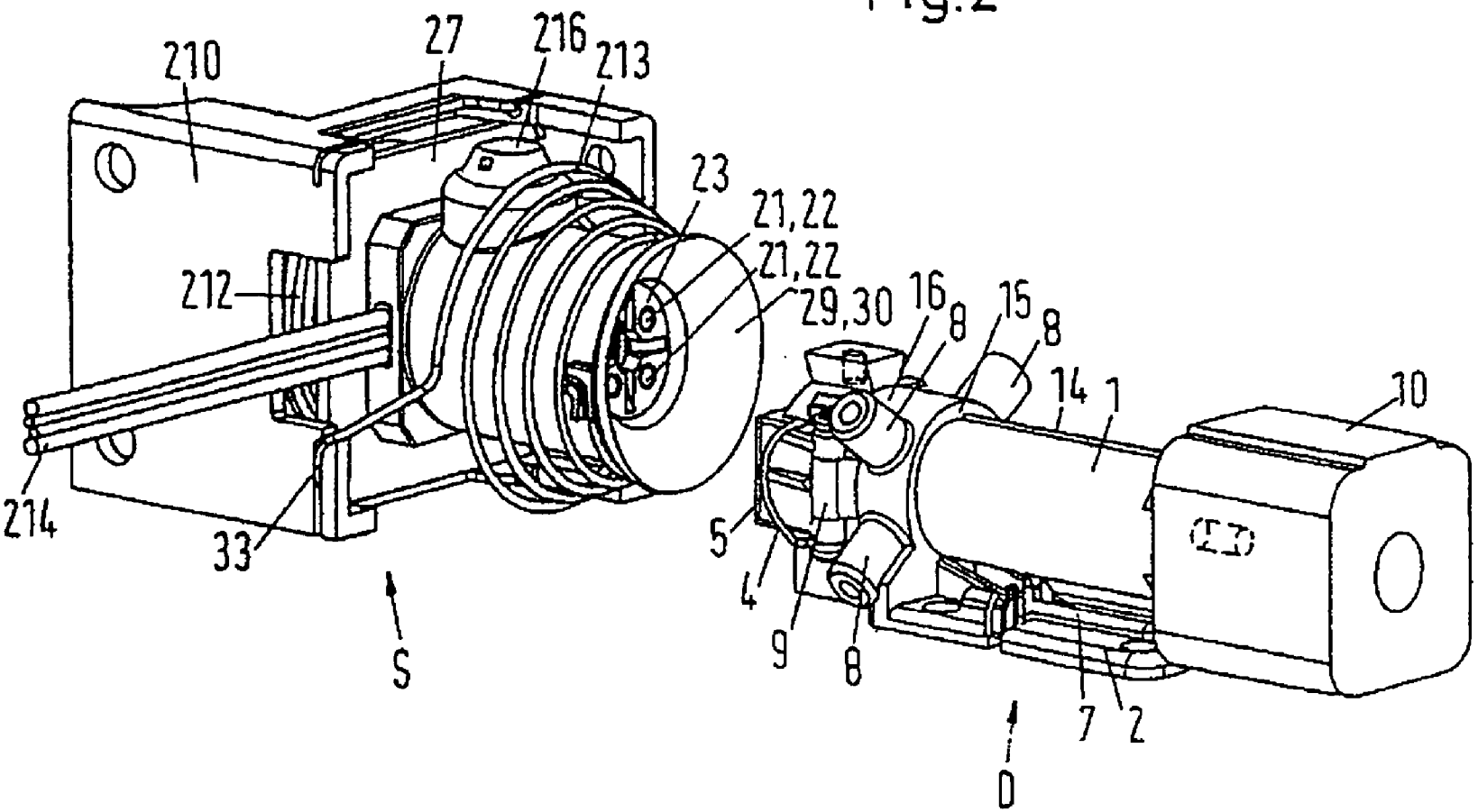
FIG. 2 is another oblique view of the device of FIG. 1.
Figure 4:
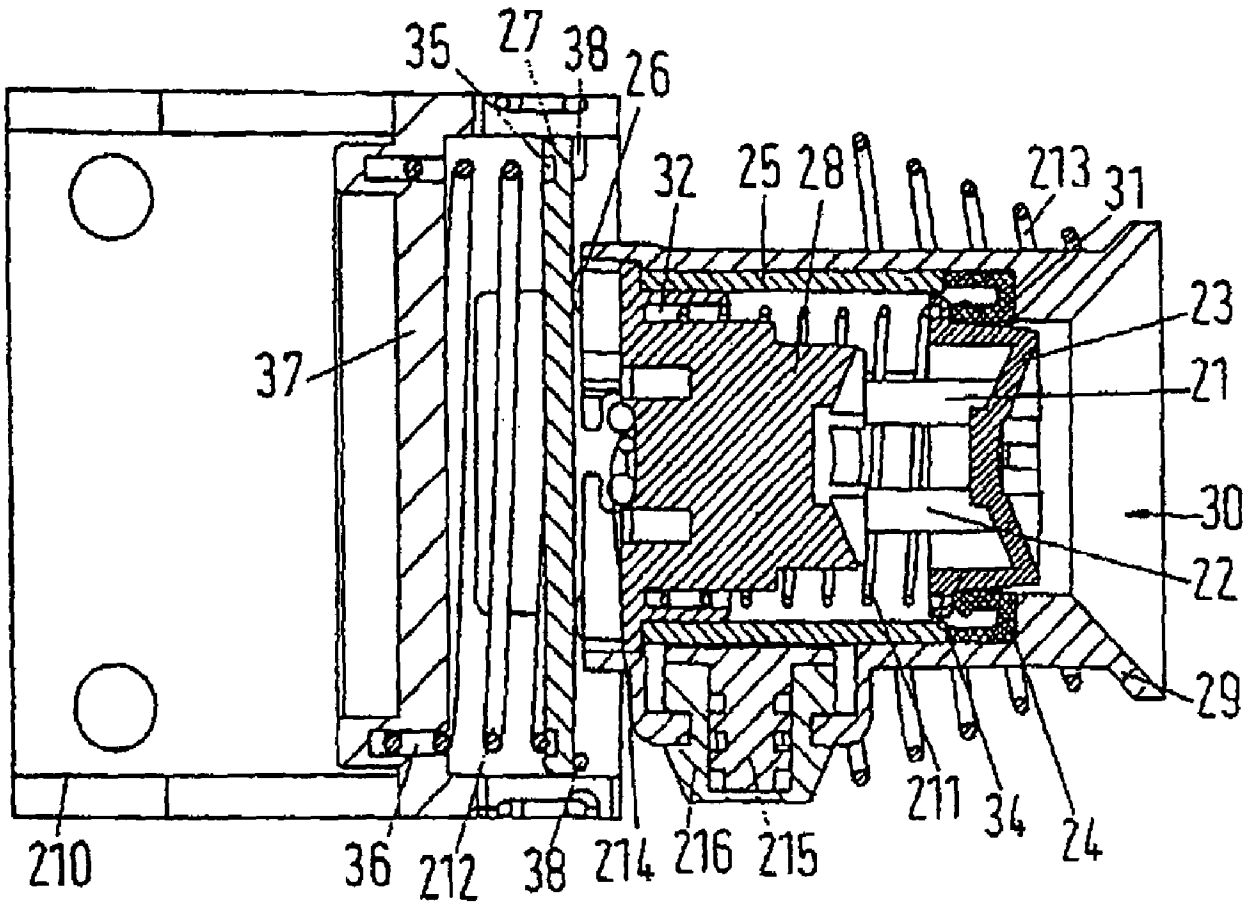
FIG. 4 is a longitudinal section of a plug according to the present invention matching the socket of FIG. 3

For the tolerance compensation of the orientation of the two connector elements in relation to each other, the plug S as shown in the FIGS. 1, 2 and 4 is mounted to provide elastic lateral deflection against the action of a retaining spring 213. The retaining spring 213 for the plug S is a spiral spring surrounding the plug housing 29 and if it is in the form of a double spiral spring is attached with its free rear ends 33 to a fastening flange 210 which can also serve as mounting flange on the vehicle. The retaining spring 213 tapers toward the front to give it the required reset characteristics.

The plug housing 29 is equipped at its front with a lead-in funnel 30 for the socket D for increasing misalignment tolerance. Moreover, the plug housing 29 is braced on a retaining plate 27 by means of a ball bearing 26 or simple spherical surfaces to allow lateral deflection against the action of the retaining spring 213.

The plug housing 29 accommodates the contact mount 28 which carries the contact pins 21, 22. In the rest position, shown in FIG. 4, the plug housing 29 is closed by a cover plate 23 with openings for the contact pins 21, 22 which just seal the openings in the rest position. The cover plate 23 is pressed against a sealing ring 24 in the form of a retaining ring on an inner shoulder 31 of the plug housing 29 by a return spring 211.

The return spring 211 is a spiral spring which sits on the contact mount 28 and is held at its rear in a circumferential groove 32 of the contact mount 28. The cover plate 23 is concave at the front matching the convex shape of the front of the socket D (see FIG. 3) so that there is additional centering for the lead-in of the socket D into the plug S. The sealing ring 24 is mounted on the front end of a spacer sleeve 25 in the plug housing 29. The cable 214 for the contact mount 28 is encapsulated in the contact mount 28 and the plug housing 29.

The retaining plate 27 on which the plug housing 29 with the contact mount 28 is braced, is mounted to be axially displaceable against the action of a return spring 212 on the fastening flange 210, which can also serve as mounting flange. The plug S can therefore elastically recede at the insertion of the socket D to compensate for jolts and/or tolerances. The return spring 212 is also a spiral spring and is accommodated at its front in a ring groove 35 of the retaining plate 27 and at its rear in a ring groove 36 of a fixed cross-plate 37 of the fastening flange 210. In idle position, the retaining plate 27 rests at the front against stops 38 of the fastening flange 210 under pressure of the return spring 212.

The plug housing 29 is equipped with a stopper 216 holding a valve core 215, which points downward when assembled, so that condensation water can drain through a baffle created in the valve core while at the same time preventing the infiltration of water (road spray, steam jets) from outside.

Figure 5:
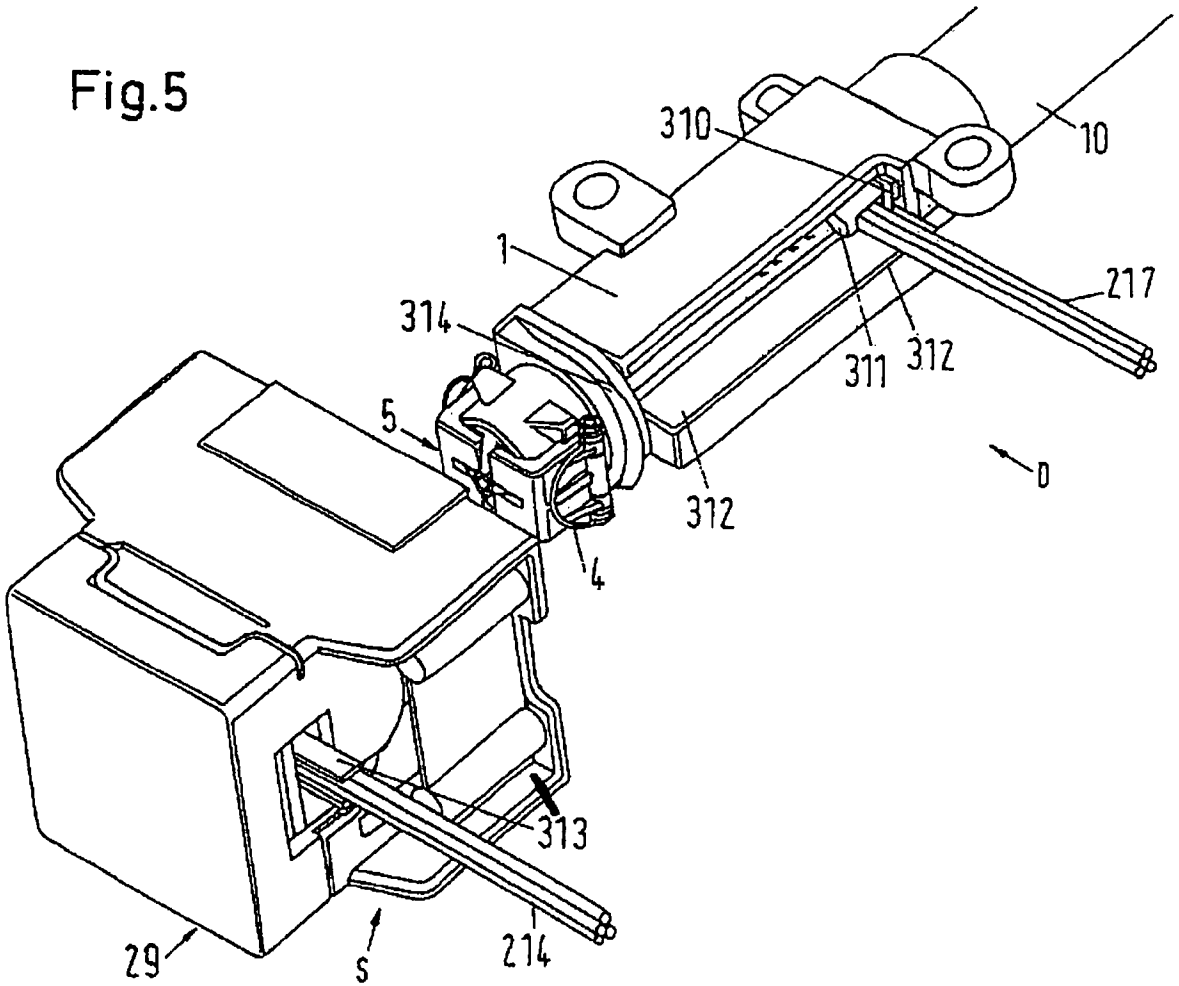
FIG. 5 is an oblique view of another embodiment of a plug-and-socket connection device according to the present invention.

In the embodiment of a plug-and-socket connection device consisting of socket D and plug S as per invention shown in FIG. 5 the following particulars are pointed out: The contact insert 1 features an emergency release 310 which ensures that in case of system failure the components of the plug-in connection can be separated mechanically. A plastic holding fixture for the exit of the cable 217 simultaneously serves as protection against torsion and coding protection 311 of the socket D. The socket D further holds two sensors 312 which detect the two positions of the socket D (inoperative or operative). Laterally projecting ribs 313 on the plug housing 29 mechanically secure it against being lifted from the retaining plate while the socket D is being pulled from the plug S. Instead of the ball locking of the socket D, it is locked in the inoperative and operative position by means of a spring clip arrangement.

Figure 6:
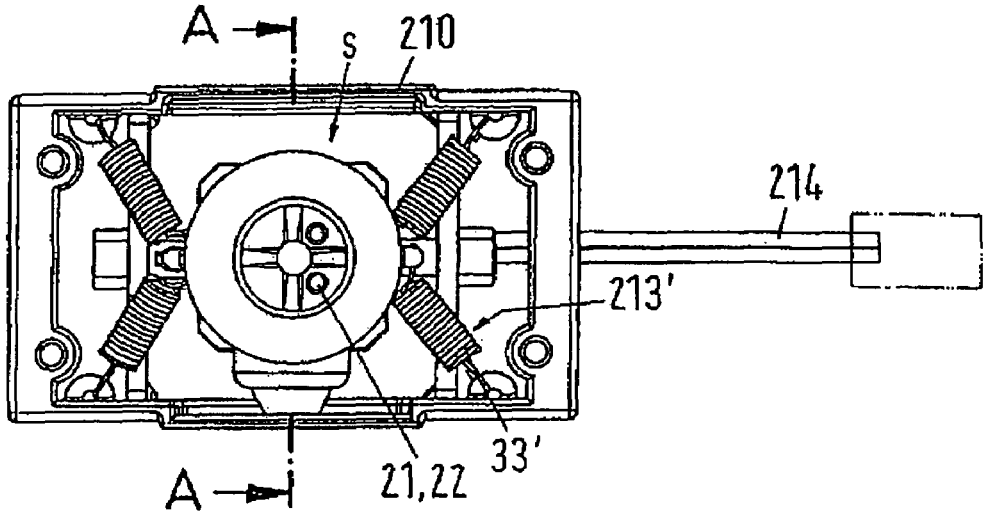
FIG. 6 is a frontal view of a plug in accordance with another embodiment of the invention, whereby the plug is retained on a fastening flange by several symmetrically acting retaining springs.
Figure 6A:
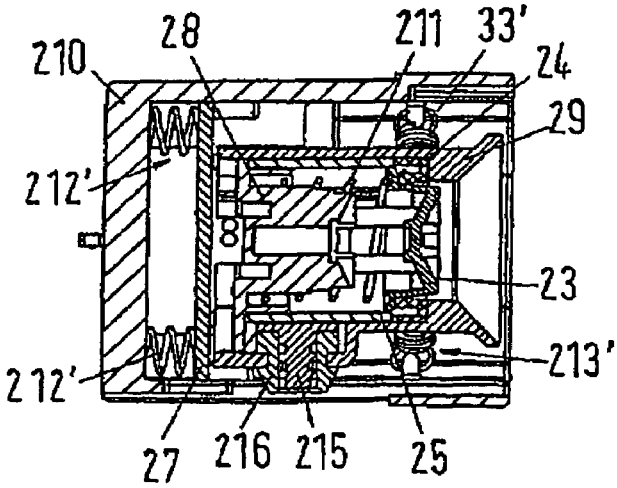
FIG. 6A is a section along section line A-A of FIG. 6.

The embodiment of a plug S according to the present invention as shown in FIGS. 6 and 6A, essentially differs from those in the FIGS. 1, 2 and 4 by the elastically laterally deflecting suspension of the plug S to the fastening flange 210. Here four individual springs 213' are used which re-center the plug S after a lateral deflection. The return spring 212 is divided into individual return springs 212'.

Other serviceable spring mountings are of course also possible.

REFERENCE NUMBERS

1 Contact Insert
2 Base Plate
3 Sealing disc for the cover 5
4 Return spring (leg springs) for the cover 5
5 Cover
6 Hexagon Socket Screw
7 Cable
8 Ball Elements
9 Swivel pins for the cover 5
10 Piston/cylinder assembly (torsion-resistant)
11 Contact Sleeve
12 Contact Sleeve
13 Tension-Relief Clamp
14 Groove
15 Rib
16 Housing Section
17 Piston
21 Contact Pin
22 Contact Pin
23 Cover Plate
24 Sealing Ring
25 Spacer Sleeve
26 Ball Bearing
27 Retaining Plate
28 Contact Mount
29 Plug Housing
30 Lead-in Funnel
31 Inner Shoulder
32 Ring Groove
33, 33' Ends of retaining spring 213
34 Collar
35 Ring Groove
36 Ring Groove
37 Cross-Plate
38 Stops
210 Fastening Flange
211 Return spring for cover plate 23
212, 212' Return spring(s) for retaining plate 27
213, 213' Retaining spring(s) (spiral spring, individual springs)
214 Cable
215 Valve Core
216 Stopper
217 Cable
310 Emergency Release
311 Protection against torsion/code protection
312 Sensors
313 Protection Against Lifting
314 Locking Device
D Socket
S Plug

The invention claimed is:

1. A plug-and-socket connection device for use in connecting a pair of vehicles including a towing vehicle and a trailer, said plug and socket connection device comprising:

a first connector element mountable to one of the pair of vehicles;

a second connector element mountable to the other of the pair of vehicles and being configured to connect together with said first connector element;

a flange secured to said first connector element and being arranged to be interposed between said first connector element and the one of the pair of vehicles for mounting said first connector element to the one of the pair of vehicles;

a drive coupled to said second connector element and configured to move said second connector element between an advanced position and a retracted position; and a plurality of springs connected between said first connector element and said flange to yieldingly hold said first connector element in an equilibrium position and, upon lateral displacement of said first connector element relative to said flange, to supply a restoring force that opposes the lateral displacement and biases said first connector element back to said equilibrium position;

wherein said first connector element constitutes one of a plug and a socket, and said second connector element constitutes the other of a plug and a socket.

2. A plug-and-socket connection device as in claim 1, wherein said plurality of retaining springs comprises four retaining springs.

3. A plug-and-socket connection device as in claim 1, further comprising a housing that houses said first connector element, and a funnel attached to said housing and configured and shaped to direct said second connector element towards said first connector element.

4. A plug-and-socket connection device as in claim 1, further comprising:

a housing that houses said first connector element;

a retaining plate mounted to said flange, on which said housing is movably mounted; and a plurality of ball bearings or spherical surfaces which act as a bearing between said housing and said retaining plate.

5. A plug-and-socket connection device as in claim 4, further comprising one or more laterally projecting ribs on said housing to prevent said first connector element from being lifted from said retaining plate while said second connector element is being disconnected from said first connector element.

6. A plug-and-socket connection device as in claim 4, further comprising a retaining plate spring; wherein said retaining plate is mounted to said flange via said retaining plate spring.

7. A plug-and-socket connection device as in claim 1, further comprising a housing connected to said flange and having an open end, wherein said housing houses:

said first connector element;

a cover plate movable between a forward rest position, in which said cover plate closes said open end of said housing, and a rearward connection position; and a return spring coupled to said cover plate and biasing said cover plate towards said forward rest position.

8. A plug-and-socket connection device as in claim 7, wherein said housing is provided with an inner shoulder at said open end;

wherein said cover plate includes an outer edge engageable against said inner shoulder of said housing; and wherein, in said forward rest position of said cover plate, said outer edge of said cover plate is engaged against said inner shoulder of said housing.

9. A plug-and-socket connection device as in claim 7, further comprising:

a spacer sleeve mounted in said housing and having an end; and a sealing ring provided on said end of said spacer sleeve;

wherein said cover plate includes an outer edge engageable against said sealing ring on said spacer sleeve; and wherein, in said forward rest position of said cover plate, said outer edge of said cover plate is engaged against said sealing ring on said spacer sleeve.

10. A plug-and-socket connection device as in claim 7, wherein said return spring comprises a spiral spring.

11. A plug-and-socket connection device as in claim 1, further comprising:

a housing that houses said first connector element;

a stopper provided in said housing; and a valve core accommodated in said stopper and configured to allow water to drain from said housing while preventing the infiltration of water from outside said housing.

12. A plug-and-socket connection device as in claim 1, wherein said drive is operable to be locked so as to retain said second connector element is said advanced position, and to be locked so as to retain said second connector element in said retracted position.

13. A plug-and-socket connection device as in claim 1, further comprising a contact insert connected to said second connector element and disconnectably mounting said second connector element to said drive, wherein said contact insert is movable between an operative position and an inoperative position.

14. A plug-and-socket connection device as in claim 13, further comprising a locking device for locking said contact insert in said operative position and for locking said contact insert in said inoperative position.

15. A plug-and-socket connection device as in claim 13, further comprising a base plate operably connected with said contact insert to resist torsion thereof.

16. A plug-and-socket connection device as in claim 15, wherein said base plate comprises a housing section having a circumferential portion, and a plurality of ball elements distributed about said circumferential portion;

wherein said housing section encompasses at least a part of said contact insert; and wherein said plurality of ball elements is configured to secure said contact insert.

17. A plug-and-socket connection device as in claim 15, further comprising:

a pair of flaps pivotably mounted to said base plate and movable between a closed configuration, in which said pair of flaps together form a cover for said second connector element when said second connector is in said retracted position, and an open configuration, in which said second connector element can be disposed in said advanced position; and a pair of springs operably coupled between said base plate and said pair of flaps, respectively, to bias said pair of flaps towards said closed configuration.

18. A plug-and-socket connection device as in claim 1, further comprising an emergency release arranged to mechanically separate said second connector element and said first connector element in a case of power failure.

19. A plug-and-socket connection device as in claim 1, further comprising a holding fixture configured to serve as protection against torsion and as coding protection of said second connector element.

20. A plug-and-socket connection device as in claim 1, further comprising sensors to detect a position of said second connector element.

* * * * *